United States Patent [19]

Cook

[11] Patent Number: 4,719,764

[45] Date of Patent: Jan. 19, 1988

[54] CHAIR WITH REFRIGERATOR AND ARMREST BEVERAGE COOLER

[75] Inventor: Myrna C. Cook, Austin, Tex.

[73] Assignee: R & R Chair, Inc., Austin, Tex.

[21] Appl. No.: 897,506

[22] Filed: Aug. 18, 1986

[51] Int. Cl.[4] ..... F25D 23/00

[52] U.S. Cl. ..... 62/261; 297/180

[58] Field of Search ..... 62/261, 258, 249, 250; 297/180

[56] References Cited

U.S. PATENT DOCUMENTS 2,782,834 2/1957 Vigo .
2,895,311 7/1959 Spalvins .
3,411,317 11/1968 Swenson et al. ..... 62/258
4,023,379 5/1977 Zevlakis ..... 62/258
4,146,279 3/1979 Stahel ..... 62/261
4,474,407 10/1984 Nazar .

*Primary Examiner*—Henry A. Bennet
*Attorney, Agent, or Firm*—Fleit, Jacobson, Cohn & Price

[57] ABSTRACT

A chair with facilities providing refreshment and relaxation and more specifically includes a chair having an armrest with a beverage can or bottle cooler incorporated therein operatively associated with a refrigeration system and a small refrigerated compartment is provided in the vertical side portion of the chair below the armrest for refrigerated storage of refreshments or edible products in position for easy access to the occupant of the chair.

9 Claims, 5 Drawing Figures

CHAIR WITH REFRIGERATOR AND ARMREST BEVERAGE COOLER

BACKGROUND OF THE INVENTION

FIELD OF THE INVENTION

The present invention generally relates to a chair with facilities providing refreshment and relaxation and more specifically includes a chair having an armrest with a beverage can or bottle cooler incorporated therein operatively associated with a refrigeration system and a small refrigerated compartment is provided in the vertical side portion of the chair below the armrest for refrigerated storage of refreshments or edible products in position for easy access to the occupant of the chair.

INFORMATION DISCLOSURE STATEMENT

Chairs have been constructed with various features ancillary to the usual function of a chair including vibrating devices, heating devices and the like. The following U.S. patents are exemplary of developments in chair structures of this type:

| | |
|---|---|
| 2,782,834 | Feb. 26, 1957 |
| 2,895,311 | July 21, 1959 |
| 4,023,379 | May 17, 1977 |
| 4,474,407 | Oct. 2, 1984 |

Above listed U.S. Pat. No. 4,474,407 discloses a portable chair with a thermally insulated compartment incorporated into the seat in which perishable foodstuffs, beverages, fishing bait or the like may be placed. However, none of the above patents utilizes a chair with a refrigeration system incorporated therein in which a refrigerated storage compartment is provided and a refrigerated can or bottle holder is incorporated into the armrest and thus, the prior patents listed above are not pertinent to this invention.

SUMMARY OF THE INVENTION

An object of the present invention is to provide a chair, such as an upholstered chair with a fixed seat and backrest or a lounge or recliner chair in which the seat and backrest are movable, in which the armrest is provided with a refrigerated beverage can or bottle holder that is accessible from the upper surface thereof and operatively connected with a refrigeration system including a compressor-condensor assembly and a refrigerated storage area with the beverage holder and the refrigerated storage area forming the evaporator portion of the refrigeration system.

Another object of the invention is to provide a chair with refreshment and relaxation facilities in accordance with the preceding object in which the refrigerated storage compartment is located in the exterior surface of the vertial portion of the chair immediately below the armrest having the refrigerated beverage bottle or can holder incorporated therein with the refrigerated storage compartment including a pivotal door hinged adjacent its bottom edge to enable the occupant of the chair to easily gain access to the interior of the refrigerated storage compartment without the occupant changing position in the chair or getting out of the chair in order to obtain items from the refrigerated storage area.

A further object of the invention is to provide a chair in accordance with the preceding objects in which the beverage bottle or can holder is in the form of a cylindrical member having an open upper end and an evaporator coil mounted thereon or incorporated therein with a closure plug or cap being provided for the open upper end of the cylindrical member to form a closure therefor when the beverage holder is not being used to hold a beverage bottle or can.

Still another object of the invention is to provide a chair in accordance with the preceding objects in which the evaporator coil and lower end of the beverage bottle or can holder extends into the interior of the refrigerated storage area in order to maintain the refrigerated storage area at a reduced temperature with a temperature control being provided along with a latch for the pivotal door and a doorstop arrangement all of which enables effective operation of the refrigeration system.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
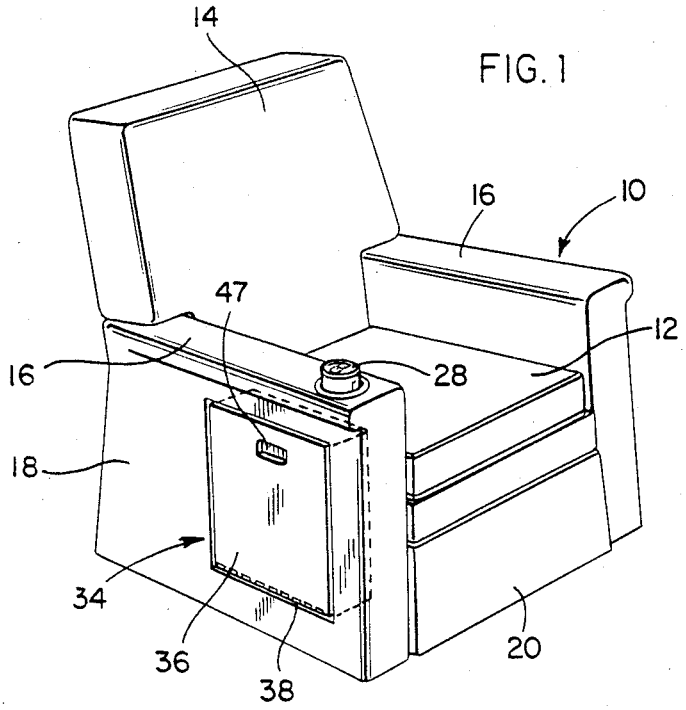
FIG. 1 is a perspective view of the chair of the present invention.
Figure 3:
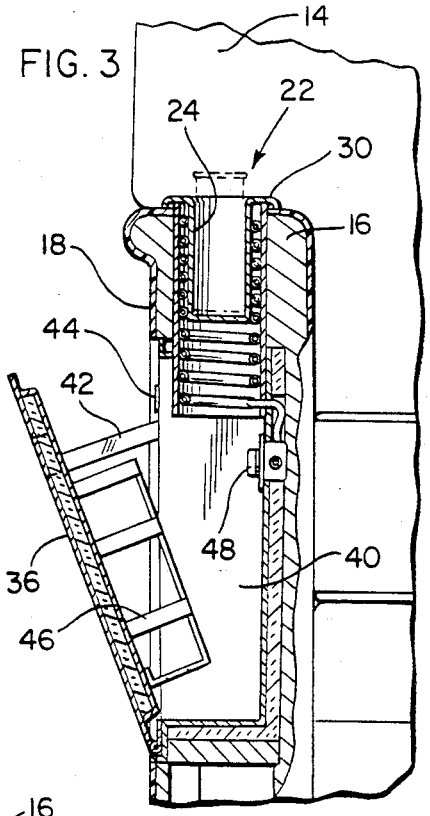
FIG. 3 is a sectional view taken generally along section line 3—3 on FIG. 1 illustrating the structure of the refrigerated beverage can or bottle holder and refrigerated storage space.
Figure 2:
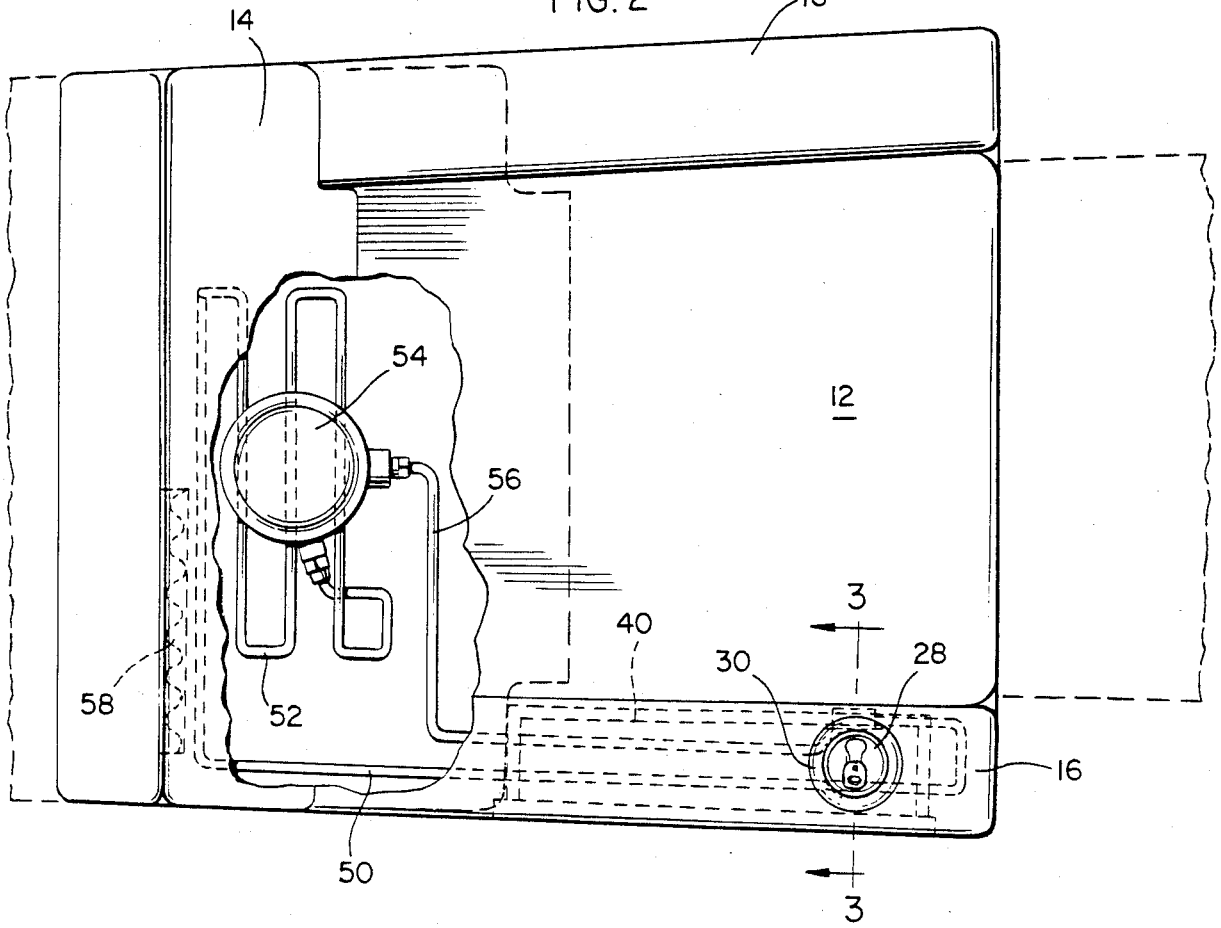
FIG. 2 is a plan view of the chair with the refrigeration system components illustrated schematically in relation thereto.
Figure 4:
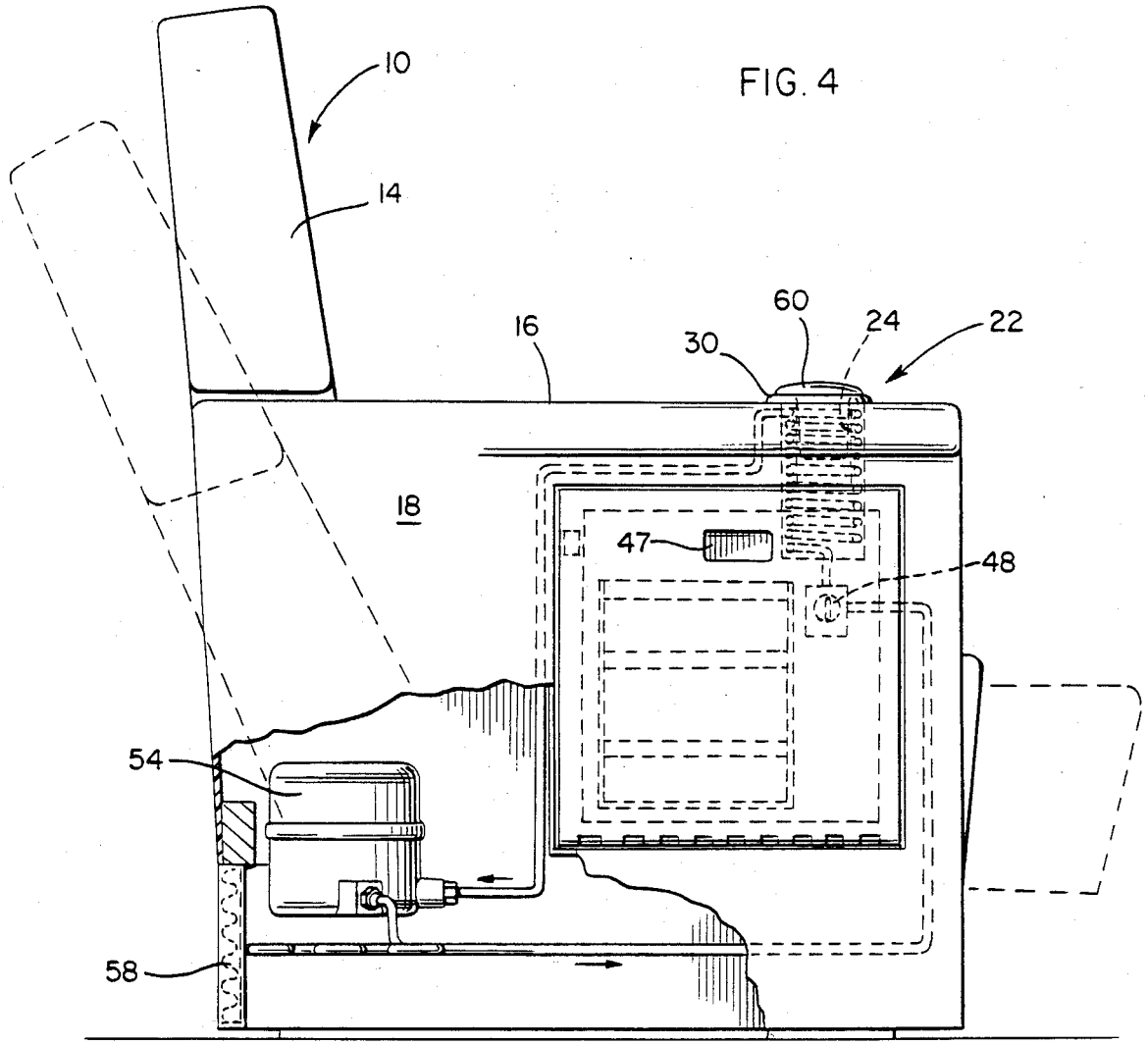
FIG. 4 is a side elevational view of the chair with the chair schematically illustrated.
Figure 5:
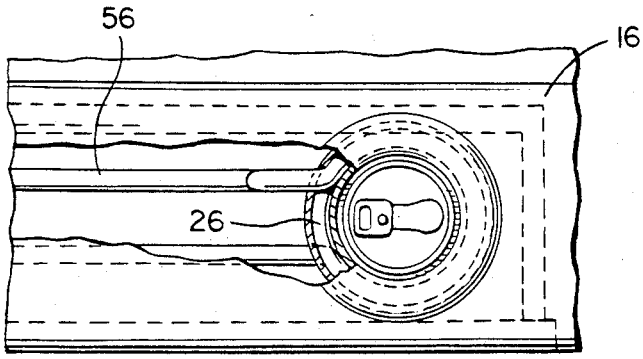
FIG. 5 is an enlarged plan view of the armrest with the beverage bottle or can holder incorporated therein.

Referring now specifically to the drawings, the chair of the present invention is generally designated by the numeral 10 and is illustrated as an upholstered reclining chair with a seat cushion 12, backrest 14, armrest 16 and sides 18. The structure of the chair in and of itself can vary and be of a rigid structure or a recliner-type chair, swivel chair, rocker or the like. A recliner-type chair is illustrated in which the backrest 14 can pivot, the seat cushion and seat assembly may also move and a footrest 20 that is normally in a vertical orientation may move generally to a horizontal position to support the feet, ankle areas or lower leg portions of the occupant of the chair.

The present invention involves the provision of a refrigerated holder generally designated by numeral 22 in at least one of the armrests 16 of the chair 10. The holder 22 includes a cylindrical container 24 having an evaporative coil 26 formed therein or mounted thereon in heat exchange relation so that a beverage can 28 positioned in the container 24 will be cooled, chilled or refrigerated as refrigerant expands through the evaporative coil 26. The container 24 includes a flange 30 at its upper end which engages the upper surface of the armrest 16 and the vertical depth of the container 24 is such that a relatively small vertical portion of the container 28 will project above the flange 30 to enable easy gripping thereof. Likewise, a bottle may be inserted into the container 24.

Incorporated into the side 18 of the chair is a refrigerated storage area generally designated by numeral 34 and which includes a door 36 hingedly connected at its lower edge at 38 to an insulated housing or casing 40. The upper edge of the door 36 is restrained from movement beyond a predetermined angle by a stop strap 42 and a magnetic catch 44 is provided in the housing 40 to retain the door in closed position with a suitable seal or gasket being provided between the door and housing 40 to maintain the insulated integrity of the interior of the housing or casing 40 which may be constructed of plastic, sheet metal or the like provided with suitable insulation on the exterior thereof and the door 36 is provided with a rack structure 46 capable of receiving a plurality of beverage cans, bottles or the like and the housing may be provided with supporting shelves or the like for edible products if desired with the interior construction of the storage compartment being varied to accommodate the particular desires of the user. The door 36 is also provided with a handle 47 to facilitate movement of the door 36 to an open or closed position. As illustrated, the container 24 and the evaporative coil 26 extend into the top of the housing 40 to cool the interior thereof with a thermostatic control 48 being provided for an expansion valve or device in a refrigerant line 50 which extends into the evaporator coil in a conventional manner. The refrigerant line 50 is incorporated into a refrigeration system including a condenser coil 52 and a motor compressor unit 54 which has a refrigerant suction line 56 connected to the evaporative coil 26 remote from the refrigerant inlet line 50. The chair may be provided with an air circulating grill 58 in registry with the condenser coil 52 to remove heat therefrom and if desired a small fan may be provided for circulating air over the condenser coil 52 in a well known manner. The refrigeration system in and of itself is a conventional mechanical compression/expansion-type refrigeration system having a capacity adequate to cool the contents of the cold storage unit 34 and the beverage can or bottle holder 22 thereby enabling the occupant of the chair 10 to have access to a beverage placed in the beverage holder 22 and gain access to the interior of the refrigerated storage area 34 in order to obtain a beverage bottle or can or obtain other products, such as edible products, from the interior of the refrigerated storage space.

A closure plug 60 is provided for the refrigerated beverage can or bottle holder to provide a relatively smooth upper surface to the armrest 16 when a beverage is not in the holder such as when the refrigeration system is not operative or when the refrigeration system is used primarily to cool the items in the storage compartment 34. The plug 60 includes a depending portion that telescopes into the container 24 and forms a seal or closure for the upper end of the holder 22. Also, the holder 22 may be provided either on the left- or right-hand armrest or on both and enables the occupant of the chair to enjoy television or merely relax and consume beverages and related products without getting out of the chair.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a chair having an armrest with an upwardly facing surface alongside and outwardly of a seat, a beverage receptacle cooler and holder, said cooler and holder including a receptacle defined by a bottom and peripheral wall extending downwardly from the upwardly facing surface of the armrest for removably receiving a beverage receptacle, and an evaporative coil means associated with the cooler and holder receptacle in heat exchange relation thereto for cooling the cooler and holder receptacle and a beverage receptacle therein, said evaporative coil means forming a portion of a refrigeration system mounted on said chair.

2. The combination as defined in claim 1 wherein said chair includes a generally vertical side member, a storage compartment in said side member, said evaporative coil means being associated with said storage compartment in heat exchange relation thereto for cooling the storage compartment, said storage compartment including an access door means in the generally vertical exterior thereof with the door means being accessible from the exterior of the side member of the chair so that an occupant of the chair can gain access to the storage compartment without moving from a normal position in the chair.

3. The combination as defined in claim 2 wherein said chair is an upholstered chair and said refrigeration system is incorporated into the interior thereof and includes a motor/compressor unit, condenser, refrigerant line and expansion device associated with the evaporative coil means with the expansion device including an adjustable control to control the cooling effect of the evaporative coil means.

4. The combination as defined in claim 3 wherein said chair includes an air grill associated with said condenser to enable heat to be removed from the refrigerant passing through the condenser.

5. The combination as defined in claim 2 wherein said access door is pivotal along its lower edge to said storage compartment with the upper edge of the door including a latch means associated with the upper edge of the storage compartment.

6. The combination as defined in claim 2 wherein said cooler and holder receptacle is in the form of a cylindrical container having a lateral peripheral flange at the upper edge thereof oriented substantially flush with the upper surface of the armrest, said evaporative coil means including an evaporator coil for refrigerant mounted in heat exchange relation to the cylindrical container, and a removable closure for the container for closing the upper end thereof when the container is not used to hold a beverage receptacle with the depth of the container being sufficient to hold a beverage bottle or can with the upper end thereof projecting at least slightly above the armrest for ease of grasping the bottle or can for consumption of the beverage by the occupant of the chair without substantial movement of the occupant.

7. In a furniture item having an upwardly facing surface accessible to a user of the item, a refrigerated recess in said upwardly facing surface, said recess having an upwardly opening upper end and being configured to closely but removably receive a beverage receptacle of the type in which the contents are consumed directly from the receptacle thereby retaining the contents of the receptacle in a desired cooled condition and in a position for direct manual grasping by the user of the furniture item.

8. The structure as defined in claim 7 wherein said refrigerated recess is in the form of a generally cylindrical container having a lateral peripheral flange at the upper edge thereof oriented substantially flush with the upwardly facing surface, a refrigeration system incorporated into the furniture item and including an evaporator coil in heat exchange relation to the container, a removable closure for the container for closing the upper end thereof when the container is not used to hold a beverage receptacle, said container having a vertical height slightly less than a beverage receptacle so that the upper end of the beverage receptacle projects above the flange to enable direct manual grasping of the upper end of the beverage receptacle for ease in consuming the contents thereof.

9. The structure as defined in claim 8 wherein said furniture item includes a generally vertical surface having an upper end coincident with the edge of the upwardly facing surface with the generally vertical surface including a storage compartment independent of the container with the evaporator coil also being associated with the storage compartment, and a pivotal access door in the vertical surface of the furniture item forming an openable closure for the storage compartment, said upwardly facing surface being disposed in an armrest of an upholstered chair having a seat extending laterally and slightly below the upper surface of the armrest with the vertical surface having the storage compartment therein being disposed coincident to the outer edge of the armrest so that the occupant of the seat can readily consume a beverage from a beverage receptacle placed in the cylindrical container and obtain additional beverage receptacles from the storage compartment without movement of the occupant from the seat.

* * * * *